United States Patent [19]

Rodvelt

[11] Patent Number: 4,524,692

[45] Date of Patent: Jun. 25, 1985

[54] ELECTRONIC INK FLOW CONTROL FOR PRINTING

[75] Inventor: Ronnie L. Rodvelt, Emporia, Kans.

[73] Assignee: Didde Graphic Systems Corporation, Emporia, Kans.

[21] Appl. No.: 601,490

[22] Filed: Apr. 18, 1984

[51] Int. Cl.[3] ..... B41F 31/14; B41L 27/16; B41L 27/38

[52] U.S. Cl. ..... 101/350; 101/DIG. 6; 101/426

[58] Field of Search ..... 101/DIG. 6, 348, 349, 101/350, 351, 352, 206, 207-210, 426

[56] References Cited

U.S. PATENT DOCUMENTS 3,765,328 10/1973 Treft et al. ..... 101/DIG. 6
3,822,643 7/1974 Mikan ..... 101/350

FOREIGN PATENT DOCUMENTS 2144636 3/1973 Fed. Rep. of Germany ..... 101/40
2340300 2/1975 Fed. Rep. of Germany ..... 101/351

*Primary Examiner*—J. Reed Fisher
*Attorney, Agent, or Firm*—Schmidt, Johnson, Hovey & Williams

[57] ABSTRACT

A method and apparatus for controlling the amount of ink transferred to the ink train in a printing press, which reduces press makeready and precisely regulates the ink transfer amount regardless of press speed. The control apparatus includes a fountain roller in operable contact with an ink supply, and a ductor roller mounted for shiftable movement between the ink train and the fountain roller. A sensor provides a signal representative of the interval of rotational movement of the fountain roller while the ductor roller is in contact with the fountain roller and thereby made available for ink transferring contact therewith. This interval is indicative of the amount of ink transferred from the fountain roller to the ductor roller for deposit to the ink train. Further, the control apparatus includes a processor control assembly which receives signals from the sensor and is operable for receiving an instruction input from the press operator indicative of the desired amount of ink transfer. The processor is programmed to correlate the operating instruction input and signal such that when a programmed relationship exists therebetween, the processor initiates shifting of the ductor roller out of contact with the fountain roller.

17 Claims, 7 Drawing Figures

Fig. 1
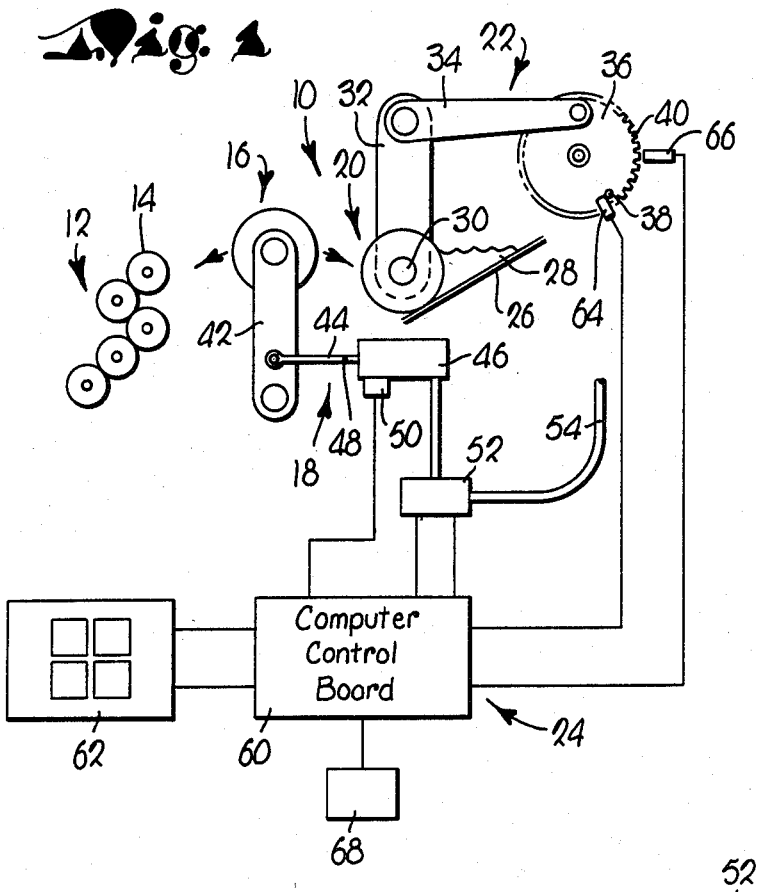
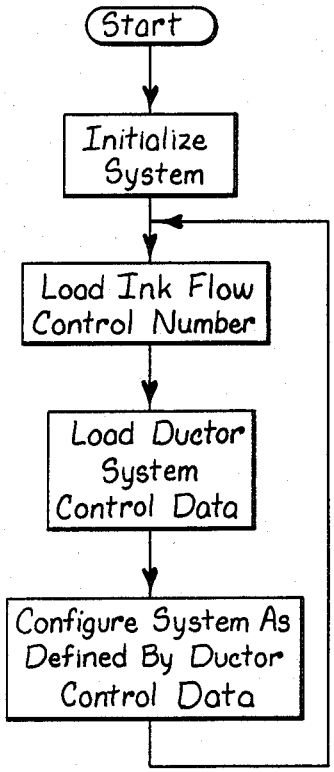
Fig. 3
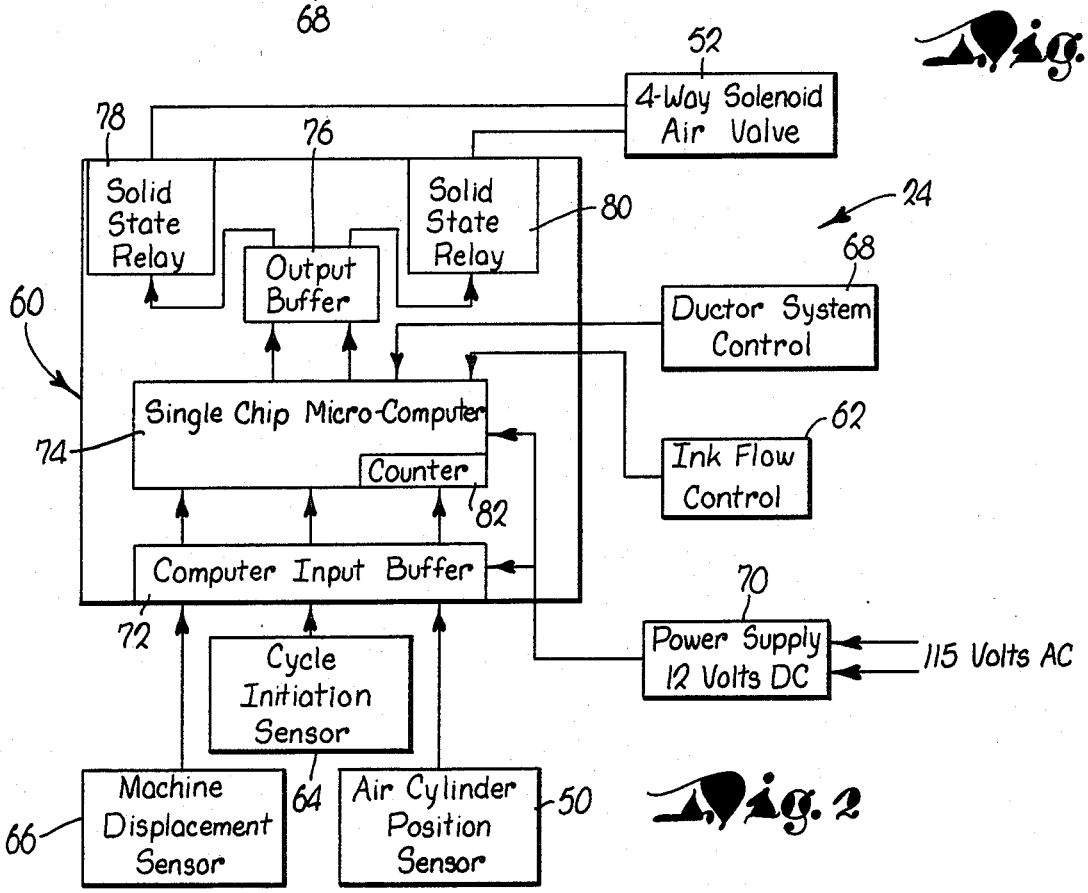
Fig. 2

Fig. 6
Prior Art Operating Characteristics
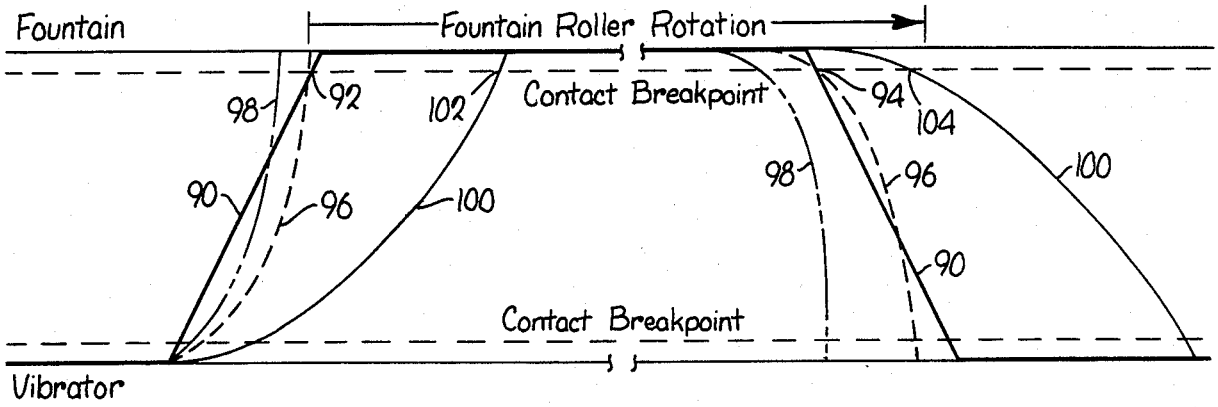
Fig. 7
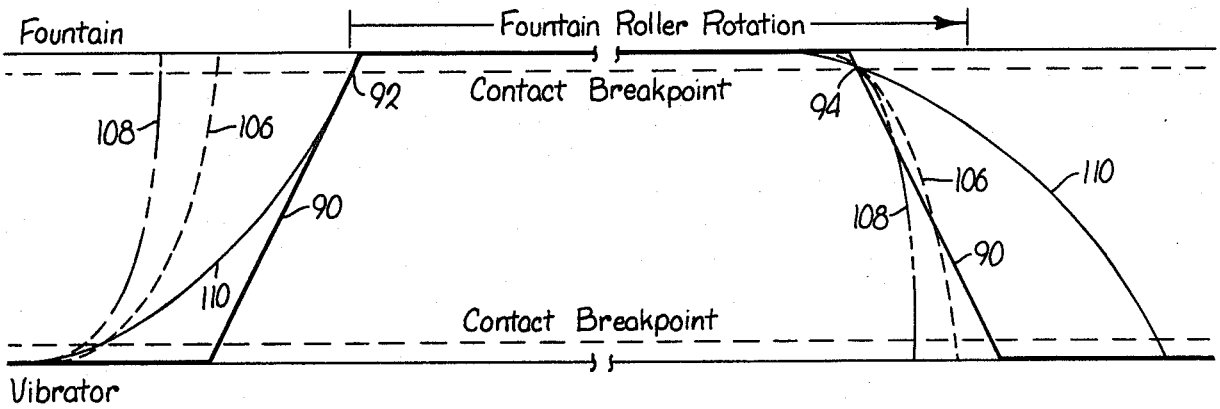
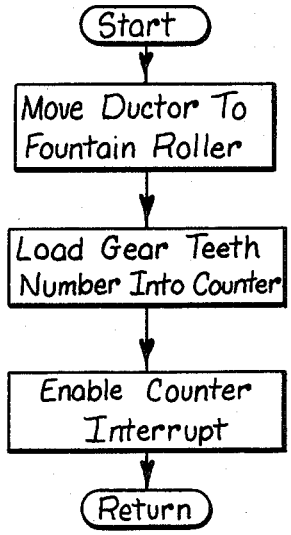
Fig. 4
Fig. 5
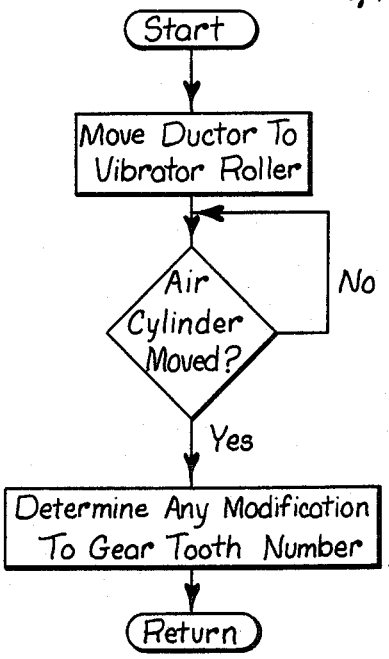

ELECTRONIC INK FLOW CONTROL FOR PRINTING

BACKGROUND OF THE INVENTION

1. Field of the Invention

This invention relates to a method and apparatus for controlling the amount of ink transferred to the ink train in a printing press, which utilizes an electronic control for precisely regulating the ink transfer in accordance with a user input even when press speed is varied.

2. Description of the Prior Art

In a typical commercial-type offset printing press, ink is deposited on the plate cylinder from an ink train having a plurality of interengaging rollers. Typically, a fountain ball or roller is mounted in contact with an ink supply and a ductor roller is shiftably mounted to cycle back and forth between the fountain roller and the ink train. When the ductor roller is in contact with the fountain roller and the fountain roller is rotated, ink is transferred to the ductor roller. The ductor roller then cycles into contact with the ink train for transfer of ink to the ink train roller while the latter is in rolling contact with the ductor roller. It will be appreciated that the interval or "dwell angle" during which the ductor roller is in contact with the fountain roller and the rollers are rotated, largely determines the amount of ink transferred to the ductor roller. In a conventional printing press, a mechanically controlled, pneumatically actuated piston and cylinder mechanism is typically connected to the ductor roller. Such mechanically controlled mechanisms are usually adjustable to regulate the interval the ductor roller is in ink transferring relation with the fountain roller. Since the shifting mechanism is driven by the main press drive, the rest of cycle reciprocation of the ductor ideally would be directly proportional to press speed. In actual fact though inherent delays in shifting of the ductor by the pneumatic mechanism introduces non-linear relationship between press speed and ductor cycling.

In web-fed commercial-type printing, particularly multi-color printing, it is essential that the amount of ink transferred to the ink train be precisely controlled to assure consistent print quality. For example, the color density of the printed image is heavily dependent upon the amount of ink deposited to the ink train. In a conventional printing press having a mechanically controlled system for shifting the ductor rollers, the press operator establishes a particular press speed for set-up purposes and adjusts the amount of ink transferred to the ink train on each individual printing tower until the final end product exhibits the desired print quality.

Several problems exist with such mechanically controlled ink transfer systems and their method of operation. First, the make-ready for such a mechanically controlled system requires a substantial amount of time for the press operator to adjust all of the printing towers to achieve the desired print quality. Thus, until the desired print quality is achieved, the press output is waste and undesirable. Furthermore, where the operator speeds up the press to its normal velocity, then the print quality degrades because of insufficient ink being supplied to the web. As those skilled in the art will appreciate, press speed is also varied in many instances during a job run and it is then necessary either to readjust the individual offset towers or to accept a lower quality print product. Thus, the provision of a control system which reduces makeready costs and assures high print quality regardless of press operating speed variations represents a significant advance in the printing art, particularly where the desired result is obtained without modifications of existing technology relating to ink trains, ink fountain supplies and drive mechanisms.

SUMMARY OF THE PRESENT INVENTION

The present invention is concerned with a method and apparatus for controlling the amount of ink transferred to the ink train in a printing press which substantially eliminates the problems associated with conventional ink flow control devices where press speed is varied from set up to run or during the run. The method and apparatus hereof easily and accurately allows the press operator to initially set up the press so that minimum adjustment of the press ink flow is necessary. This feature substantially reduces the waste associated with conventional ink transfer regulating systems, and is helpful to press operators of all skill levels. Further, the method and apparatus hereof accurately controls the amount of ink transferred to the press ink train even when press speed is varied. For example, when the press is accelerated to a faster operating speed than that used during the press set-up, the method and apparatus hereof consistently transfers the desired amount of ink during the acceleration and at the elevated velocity to yield a high quality print notwithstanding change of the press speed.

The ink flow control of the present invention includes a fountain roller operably associated with an ink supply and a shiftably mounted ductor roller. The ductor roller picks up ink from the fountain roller during the interval of time that contact is established between the ductor and fountain rollers and the rollers are rotated. A sensor provides a signal representative of the amount of ink transferred as a result of rotational movement of the fountain roller during such ink transfer interval. A micro processor is provided which receives the signal from the sensor. The press operator provides an instruction input to the processor indicative of the desired amount of ink to be transferred. The processor compares the representative signal with the operating instruction input and is programmed to control shifting of the ductor roller in a manner to regulate the ink transfer interval in correlated relationship with the input instruction. The fountain roller operates in a duty cycle of rotation and non-rotation and preferably, the ductor roller is shifted into contact with the fountain roller before the fountain roller begins ink transferring rotation. Thus, control of the amount of ink transferred to the ductor roller is largely a function of the timing of disconnect of the duct roller from engagement with the fountain roller. The processor operates to initiate disengagement of the ductor roller when a programmed relationship exists between the operating instruction input and the signal provided from the sensor. It will be appreciated that the programmed relationships established in the processor allow for any one of a number of operating instruction inputs, with the programmed relationships being operable to maintain a high print quality at all print speeds including normal run velocities.

In a preferred form of the invention, the ink flow control includes a feed back mechanism which determines when the ductor roller actually disengages from contact with the fountain roller and supplies an indication of the disengagement to the processor. The processor operates to compare the delay between the initiation of ductor roller disengagement and the indication received from the feed back mechanism. The processor adjusts the programmed relationship currently in use to account for the delay to assure high quality printing regardless of any such actuation delay.

Preferably, the control is provided with a transmission mechanism which causes intermittent rotational movement of the fountain roller in a duty cycle of rotation and non-rotation. The transmission includes a rotatable gear interconnected to the fountain roller. The gear has a plurality of spaced apart markings thereon and a detection mechanism which senses passage of the markings therepast. The detection mechanism generates a signal for each mark and feeds the signals to the microprocessors. Because the transmission rotates the fountain roller, the number of markings detected correlates to the amount of rotational movement of the fountain roller. The processor operates to count the signals and initiates the disconnect of the ductor roller from the fountain roller when the programmed relationship is reached.

BRIEF DESCRIPTION OF THE DRAWINGS

FIG. 1 is a schematic view of the ink flow control of the present invention;

FIG. 2 is a block diagram of the microprocessor used in the present invention, and the relation of input and output sources thereto;

FIG. 3 is a flow chart for the main operating program of the microprocessor illustrated in FIG. 2;

FIG. 4 is a flow chart depicting the external interrupt program;

FIG. 5 is a flow chart of the counter-interrupt program;

FIGS. 6 and 7 are graphs of press ductor operating characteristics with the ordinate of each graph being ductor position and the abscissa machine displacement (web feet of travel through the press), wherein:

FIG. 6 illustrates the operating characteristics of a prior art ductor control, and FIG. 7 is a graph illustrating the operating characteristics of ductor control in accordance with the present invention.

DESCRIPTION OF THE PREFERRED EMBODIMENT

Turning now to the drawings, FIG. 1 illustrates schematically an ink flow control 10 for transferring ink to an ink train 12 in a printing press. The ink train 12 (illustrated only schematically as a series of interengaging rollers the number of which varies from press to press) includes an uppermost vibrator roller 14 which serves as the initial point of ink pick-up. The ink is transferred from roller to roller in the ink train 12 for deposit on the plate cylinder (not shown) of the printing press.

Broadly speaking, the ink flow control 10 include a ductor roller 16, ductor shifting mechanism 18, a fountain roller 20, a fountain drive transmission 22, and an electronic control assembly 24. As shown in FIG. 1, the fountain roller 20 is rotatably associated with an ink fountain 26 of conventional design. The ink fountain 26 receives the viscous ink 28 and includes a plurality of ink keys (not shown) which regulate the amount of ink 28 deposited on the fountain roller 20. The fountain roller 20 is also conventional in the sense that upon rotation thereof, the ink 28 adheres to the outer surface. The drive transmission 22 includes a unidirectional clutch 30 which serves to impart an axial rotation to the fountain roller 20.

The fountain drive transmission 22 has a first link 32 connected to the unidirectional clutch 30 and a second link 34 pivotally connected to the link 32. The link 34 is pivotally joined at its distal end to an axially rotatable gear 36 driven by the main press drive. The gear 36, which has a magnet 38 thereon and presents a plurality of equidistant, circumferentially spaced apart, peripheral teeth 40. The gear 36 is operatively coupled to the main press deive at a suitable reduction ratio, and under normal conditions, continuously rotates when the press is operated. Rotation of the gear 36 in turn imparts a reciprocating movement to the link 32 via the link 34. The unidirectional clutch 30 translates the reciprocating movement received from the link 32 into a intermittent rotational movement of the fountain roller 20. Thus, the fountain roller 20 axially rotates in one direction in a repetitive duty cycle of rotation and non-rotation.

The rubber covered ductor roller 16 is mounted for intermittent shiftable movement between the fountain roller 20 and vibrator roller 14 under the control of the shifting mechanism 18. For purposes of simplicity, only one mechanism 18 is illustrated. It is to be understood though that a pair of such assemblies operating in tandem may be employed if desired to avoid application of asymmetrical forces to the ductor roller 16 during reciprocal movement thereof. The ductor shifting mechanism 18 as shown includes an elongated arm 42 having one end rotatably mounting the ductor roller 16 while the other end is mounted for pivotal movement about a fixed point. A piston 44 of a multi-positional air cylinder 46 is operatively coupled to the arm 42 and controls the shifting thereof as shown at FIG. 1. Piston 44 has mounted thereon a second magnet 48 while the air cylinder 46 has a position sensor 50 which detects movement of the magnet 48 therepast when the piston 44 moves. A multi-positional air solenoid 52 controls supply of air to the air cylinder 46 and is connected to an air supply (not shown) by pneumatic line 54.

The electronic control assembly 24 illustrated in FIG. 1 includes a computer control board 60 which operates to control the solenoid valve 52 and receives inputs from a number of sources. One input to the board 60 is from the two digit thumb wheel switch assembly 62 which supplies a press operator furnished ink flow control operating instruction input to the board 60. The input number set in the thumb wheel switch 62 is indicative of the desired amount of ink to be transferred from the fountain roller 20 to the ductor roller 16. The number set in thumb wheel switch 62 is preferably passed to the board 60 as an 8-bit Binary Coded Decimal (BCD) value.

Another input to the board 60 is from the cycle initiation sensor 64. Preferably, the sensor 64 is a Hall effect-type position sensor disposed adjacent the gear 36 which operates to supply a 12 volt electrical signal indication to the board 60 when the magnet 38 travels therepast. A Hall effect sensor such as a Series 200SR manufactured by Microswitch, Inc. has proven operable in this regard. Preferably, the output signal from the sensor 64 is passed through an optoisolator (not shown) for input to the computer control board 60 as a 5 volt logic voltage signal. In this regard, isolator model H11L1 made by General Electric incorporates a microprocessor compatible Schmitt trigger and has proven effective in passing a digital signal from the sensor 64 to the board 60.

Another input into the computer control board 60 is from the machine displacement sensor 66. The sensor 66 is disposed adjacent the gear 36 and essentially counts the number of gear teeth travelling therepast. A Photoswitch, Inc. type 51 inductive sensor has proven effective in counting the teeth 40 of the gear 36. The 12 volt output from the machine displacement sensor 66 is preferably passed through an optoisolator, such as General Electric's Model H11L1, for inputting a logic voltage signal to the board 60.

It is also to be seen from the schematic diagram of FIG. 2 that another input to the control board 60 is the signal generated by position sensor 50 when activated by magnet 48.

A final input to the computer control board 60 is the ductor system control switch 68 which functions to regulate the operation of the ductor roller 16. Preferably, the ductor control switch 68 is a three pole, five position rotary switch having the following modes—on, auto, free, vibrator, and fountain. In the on mode, the ductor shifting mechanism 18 operates normally to shift the ductor roller 16 between the ink train 12 and fountain roller 20, regardless of whether or not the the ink form rollers of the printing press are being rotated. In the auto mode, the ductor shifting mechanism 18 operates normally only if the ink forms are activated. In the free mode, the ductor shifting mechanism 18 disrupts the air pressure to the air cylinder 46, taking the pressure off of the ductor roller 16 and effectively disabling the operation thereof. In the vibrator mode, the ductor shifting mechanism 18 operates to move the the ductor roller 16 into contact with the vibrator roller 14 of the ink train 12. The vibrator mode is particularly useful in clean-up operations to extract most of the ink from the ductor roller 16. Finally, in the fountain mode, the ductor shifting mechanism 18 moves the ductor roller 16 into contact with the fountain roller 20 and retains the ductor roller in that position. The fountain mode is useful during makeready of the press, for example to set the individual ink keys of the ink fountain 26.

Turning now to FIG. 2, the computer control board 60 and the input and output devices coupled thereto are illustrated in block diagram form. A 12 volt DC power supply 70 provides power to the computer control board 60 and preferably has a voltage regulator coupled thereto for supplying logic voltage to the board 60 (a voltage regulator such as National Semiconductor Model LM7805 has proven operable). The control board 60 includes an input buffer 72, a single chip microcomputer 74, an output buffer 76, and a pair of relays 78, 80 operatively connecting the output buffer with the solenoid air valve 52.

Those skilled in the art will appreciate that the microcomputer 74 could comprise a wide variety of different types of digital processors with either on chip or external memory. In the preferred embodiment, the microcomputer 74 is an Intel Corporation Model 8748 having an eight bit CPU and a single level interrupt. The microcomputer 74 contains a 1K ×8 erasable, user-programable program memory (EPROM), a 64 word data memory (RAM), 27 I/O lines, and an eight bit timer/counter. The position of the ductor control switch 68 is fed directly to the microcomputer 74 (pins P10–P12). The appropriate signal indicative of the setting in the two digit thumb wheel switch 62 is also fed directly to the microcomputer 74 (pins P20–P27). Cycle initiation sensor 64, machine displacement sensor 66 and air cylinder position sensor 50 feed directly to the input buffer 72 (via appropriate optoisolators). In this regard, it is noted that the signal generated from the cycle initiation sensor 64 is fed to the interrupt pin of the microcomputer 74 and initiates an external interrupt, assuming the interrupt feature is enabled. Further, the signal generated from the machine displacement sensor 66 is fed to the timer/counter function of the microcomputer 74 (pin T1) and designated a counter input using the appropriate mnemonic. The counter portion of the microcomputer 74 is labelled 82 in FIG. 2, it being understood that the counter function operates to count from 0 to 255 and generates an internal interrupt upon rollover from 255 to 0.

OPERATION AND CONTROL SEQUENCE

Operation of the ink flow control 10 in accordance with the present invention is most easily understood from the control sequence depicted in the flow charts of FIGS. 3, 4, 5. In this regard, the program listing included herein sets forth in detail the control sequence. The program listing includes source statements and comments for the main program (FIG. 3), for the trigger or external interrupt program (FIG. 4) and for the counter interrupt program illustrated in FIG. 5. In addition to the main, external interrupt and counter interrupt programs, the program memory (EPROM) of the microcomputer 74 includes the look-up table contained on page 5 of the program listing. The look-up table represents a programmed relationship between the number of gear teeth 40 expected to be counted by the sensor 66 and the ink flow input set on the thumb wheels of the switch 62.

Turning to the flow chart of the main program depicted in FIG. 3, after power up, program execution moves to the beginning of program memory and enters an initialization sequence which clears the internal registers of the microcomputer 74 and initiates a signal to the output buffer 76 to move the ductor roller 16 into contact with the vibrator roller 14 while the rest of the main program is executed. This signal causes the solid state relay 78 to close and actuates the solenoid air valve 52. Actuation of the solenoid valve 52 in turn causes air under pressure to be directed to air cylinder 46 thus extending piston 44 and effecting shifting of the ductor roller 16 into contact with vibrator roller 14.

The next step in the main program flow chart of FIG. 3 involves loading of the ink flow control number from the thumb wheel switch 62 (scan routine in the attached program listing). In this routine, the computer simply reads in the two digit (3 bit BCD valve) ink flow input number and stores the number in a temporary register. The computer uses the ink flow input as a pointer in the look-up table to find the number of gear teeth 40 programmed to correspond to the ink flow input number. If the ink flow input number read from the thumb wheel switch 62 is the same as the input number previously used and stored in the register, then it is not necessary to enter the look-up table as no change in the number of gear teeth is needed.

The next step in the main program is concerned with loading of switch position of the ductor system control mode set switch 68 into the microcomputer 74. The final step is configuration of the ink flow control 10 according to the position of the ductor control switch 68. That is, the selected one of the five modes (on, auto, free, vibrator, and fountain) which has been selected on the control switch 68 must be known by the microprocessor 60. In the free, vibrator, and fountain modes, the external (or trigger) program interrupt (FIG. 4) is disabled. In the auto mode, the external program interrupt is disabled unless the form rollers are activated on the press. In the auto mode with the form rollers activated and in the on mode, the external program interrupt is enabled. It should be noted that the ductor system control switch 68 for normal operation is placed in either the on or auto mode settings.

After the ink flow control 10 is configured as defined by the ductor control switch 68, the program jumps back to the "load ink flow control number" step in the flow chart of FIG. 3. Essentially, the program operates in a continuous loop to continually monitor the settings of the thumb wheel switch 62 and ductor control switch 68 for any changes made by the operator.

Turning to FIG. 4, the flow chart for the trigger or external interrupt program is illustrated. Assuming the press is in normal operation, the external interrupt is enabled (the "on" mode or "auto" mode with forms enabled). The external interrupt routine of FIG. 4 is entered when the sensor 64 detects passage of the magnet 36 therepast. The signal generated by the sensor 64 is directed to the interrupt pin of the microcomputer 74 (via optoisolator and input buffer 72) interrupting the main program of FIG. 3 and entering the external interrupt program of FIG. 4. In the first step in the interrupt program the ductor roller 16 is moved into contact with the fountain roller 20. To effectuate the move, the microcomputer 74 generates a signal to the output buffer 76 which activates the relay 80 and solenoid air valve 52. Air valve 52 causes the air to be directed to air cylinder 46 in a direction to effect retraction of the piston 44, forcing the ductor roller 16 into contact with the fountain roller 20. It has been found preferable to move the ductor roller 16 into contact with the fountain roller 20 before the fountain roller begins rotation. Therefore, magnet 38 is located on gear 36 in disposition such that even at maximum press operating speed, the sensor 64 will generate a signal which ultimately moves the ductor roller 16 into contact with the fountain roller 20 while the fountain roller 20 is still in the non-rotation stage of its duty cycle.

The next step in the external interupt program of FIG. 4 involves loading of the gear tooth number found from the look-up table into the counter portion 82 of the microcomputer 74. With the counter 82 enabled, the counter counts the pulses generated by the air cylinder position sensor 50 in accordance with the gear teeth displaced therepast. The external interrupt program enables the counter interrupt function allowing the counter 82 to signal the microcomputer 74 when the required number of gear teeth are counted. Preferably, the look-up table contains the 2's complement of the gear teeth number such that the counter interrupt occurs on rollover from 255 to 0. After the counter interrupt feature is enabled, program execution then returns to the main program of FIG. 3 to monitor any changes to the thumb wheel switch 62 or ductor control switch 68 while the counter 82 operates.

As soon as the ductor roller 16 is brought into contact with the fountain roller 20, the ductor roller 16 and fountain roller 20 are in a position for ink transfer. However, effective ink transfer does not begin until the fountain roller 20 begins rotation. The "interval" (also referred to as "dwell angle") during which the rollers 16, 20 are in contact and rotating is determinative of the amount of ink transferred to the ductor roller 16. Therefore, for the amount of ink transferred to the ductor roller 16 to be accurate for high quality printing, it is necessary that the ductor roller 16 disengage from contact with the fountain roller 20 at the appropriate time, and most especially in the preferred embodiment of the present invention in accordance with the ink flow operating instruction input set on the thumb wheel switch 62. The programmed relationship of the operating instruction input to gear tooth count found in the look-up table is established to give an initial, near optimum disconnect of the ductor roller 16 from the fountain roller 20. As a tooth 40 passes the inductive sensor 66, a pulse signal is generated which ultimately causes the counter to be incremented for each tooth 40 sensed. When the counter rolls over to zero, an internal interrupt is generated which causes program execution to jump from the main program to the counter interrupt program shown in FIG. 5.

Turning now to FIG. 5, the counter interrupt program first causes the ductor roller 16 to move from a position in contact with the fountain roller 20 to a position in contact with the vibrator roller 14. To accomplish this, the microcomputer 74 outputs a signal through the output buffer 76 to the relay 78 actuating the solenoid air valve 52. The air valve 52 causes actuation of the air cylinder 46, with piston 44 being displaced to push the ductor roller 16 into contact with the vibrator roller 14 (shifting right to left as shown in FIG. 1).

Even after the counter interrupt program is entered, the counter 82 continues to count gear teeth sensed by the inductive sensor 66. The counter 82 stops when the microcomputer 74 indicates that the ductor roller 16 has actually disengaged from the fountain roller 20. In the preferred embodiment, the actual disengagement of the rollers 16, 20 is determined inferentially by disposition of magnet 48 on the piston 44 in a location such that the position sensor 50 generates a signal at the moment of disengagement. The signal from the position sensor 50 is supplied to the microcomputer 74 which stops the counter.

On power-up, the gear tooth number from the look-up table is placed in a temporary register as the "active" gear tooth number in the counter 82. The "active" gear tooth number is then either incremented, decremented, or left unchanged dependent upon the delay between initiation of disengagement by the microcomputer and the time when the microcomputer 74 receives the disengage signal from the position sensor 50. That is, the number of gear teeth counted by the counter 22 during the delay (counter overflow) is added to the active gear tooth number and the sum compared with the original look-up table tooth number. If the sum is less than the look-up table number, the "active" gear tooth number is decremented. If the sum is equal to the look-up number no change is made. If the sum is greater than the look-up number, the "active" number is incremented. It should be appreciated that this feature provides compensation for changes in press speed. After modification of the gear tooth number is made, the execution returns to the main program. The ductor roller 16 remains in contact with the vibrator roller 14 and the microcomputer 74 executes the main progress until the magnet 38 is again sensed by the Hall Effect sensor 64. As previously described, the sensor 64 initiates a signal which generates an external interrupt, and program execution jumps to the external interrupt program (FIG. 4). Thus, another ductor cycle begins as previously described.

DESCRIPTION OF OPERATING CHARACTERISTICS

The ductor cycle operating characteristics of a typical prior art press is graphically depicted in FIG. 6, while FIG. 7 illustrates the ductor cycle operating characteristics of the ink flow control 10 of the present invention. Both FIGS. 6 and 7 present ductor roller position as the ordinate plot versus machine displacement as the abscissa. Machine displacement is usually expressed in terms of surface feet of web travel through the printing press. On both graphs, the angular displacement of fountain roller rotation is depicted along the uppermost margin thereof. The lowermost margin of the graphs is used to denote the position of the ductor roller 16 which it is in contact with the vibrator roller 14. The uppermost margin of each graph is the position of the ductor roller 16 while it is in contact with the fountain roller 20. For comparison purposes, position of a ductor roller under ideal conditions (e.g. instantaneous constant velocity) is labeled as ideal line 90 in both FIGS. 6 and 7.

Starting from left to right in FIGS. 6, and 7, it is seen that an ideal ductor roller (line 90) would be operated to break contact with the vibrator roller and without actuation delay, then travel at an instantaneous, constant velocity until the ductor roller contacts the fountain roller. The point labeled in 92 in FIGS. 6 and 7 is the point at which the ideal ductor roller first contacts the fountain roller. Optimally, the ideal ductor roller will contact the fountain roller at the instant the fountain roller begins to rotate, as illustrated in the drawing. The point labelled in 94 in the drawings is the point at which the ideal ductor roller would break contact with the fountain roller. It will be appreciated that the interval (dwell angle) between points 92 and 94 denotes the ink pick-up phase; that is, the ductor roller and the fountain roller are in ink transferring relation when in contact during fountain roller rotation.

In FIG. 6, the inverted U-shaped line labeled 96 graphically denotes the path of travel of the ductor roller from the time of engagement with the fountain roller until contact therewith is broken in a conventional printing press at press set-up speed. In a conventional printing press, the press operator adjusts the dwell angle of the ductor roller until the optimum print quality at set-up speed is achieved. For optimum print quality to occur, line 96 intersects ideal points 92, 94.

Inverted U-shaped line 98 of FIG. 6 is a depiction of the position at any instant of time of a prior art ductor roller at a press speed slower than initial press set-up speed. Slowing a printing press down from the initial set-up speed is common, for example to pass a web splice through the printing press. The primary difficulty in slow speed press operation as illustrated by line 98, is that the ductor roller disengages from the fountain roller before the ideal break point 94. Thus, the interval of ink transfer from point 92 to contact break point, is less than the ideal ink transfer interval established at press set-up speed. The amount of ink transferred to the ductor roller, and hence to the ink train, is less than ideal and either print quality is sacrificed or the press operator must recalibrate the movement of the ductor roller to achieve the ideal ink transfer interval.

Finally, inverted U-shaped line 100 graphically illustrates the positions on a time basis of a conventionally controlled ductor roller at a press speed greater than the initial press set speed. Hereagain, this is a common occurence, in that a press operator normally uses a moderate press speed for set-up purposes to reduce the amount of waste occuring during set-up, and the operator then generally increases press speed for the job run. As illustrated in FIG. 6, the position of line 100 deviates sufficiently from the ideal line 90 to make it difficult if not impossible possible for the operator to continue press operation at a particular speed without readjustment of the ductor roller dwell angle against the fountain roller 20. In FIG. 6, the point of contact of the ductor roller with the fountain roller 20 under the high speed conditions of line 100 is labeled 102, and the point of disengagement is labeled 104. It is seen that the deviation of point 102 from the ideal point 92 is substantially different from the deviation of point 104 from point 94, with the result that the ink transferring interval between point 102 and 104 deviates from the ideal. A wide variety of factors are involved in contributing to these deviations. For example, the rate of change of ductor shifting is not proportional to changes in machine displacement, with the end result being that when a conventional printing press is operated at other than press set up speed, ink transfer deviates from the ideal. Ink transfer is a significant factor in print quality. This is one reason that in a conventional printing press, ductor roller shifting must be either readjusted or print quality sacrificed when press speed is changed.

Turning now to FIG. 7, the operating characteristics of ink flow control 10 of the present invention is graphically shown in a format similar to FIG. 6. The inverted U-shaped line labeled 106 is a plot of the positions of the ductor roller 16 versus machine displacement at initial press set-up speed. During set-up, the press operator inputs a predetermined, initial ink flow setting into the thumb wheel switch 62 suitable for the job run. In this regard, the look-up table has been established to give a programmed relationship between ink flow input and gear tooth count number to yield a good print quality during makeready. Thus, waste during makeready using the ink flow control 10 of the present invention is reduced when compared with conventional printing presses.

Inverted U-shaped line 108 is a plot of the positions of the ductor roller 16 at a press speed lower than initial set-up speed, while inverted U-shaped line 110 represents a plot of ductor roller positions at the maximum press operating speed. Significantly, at all press operating speeds, the ductor roller 16 engages the fountain roller 20 before the fountain roller begins rotation. Thus, even at maximum press operating speed (line 110) ductor roller 16 is in contact with the fountain roller ready for ink transfer as soon as the fountain roller begins the rotation phase of its duty cycle (approximately point 92 in FIG. 7). Because the counter interrupt program modifies the gear tooth number count to acommodate actuation delays in the ductor roller, the ductor roller 16 disengages from the fountain roller at approximately the ideal break point 94, regardless of press operating speed. That is, during acceleration and deceleration of the press and at different press operating speeds, the ink flow control system 10 constantly modifies the ductor dwell angel, if necessary, to approach an ideal ink transfer interval. Those skilled in the art will appreciate that the method and apparatus of the present invention represents a significant advance in the art in reducing problems associated with press makeready and ensuring a high print quality notwithstanding changes in press operating speed.

COMPUTER PROGRAM LISTING

```
:SIS-II MCS-48/UPI-41 MACRO ASSEMBLER, V2.0          PAGE    1

LOC  OBJ        SEQ       SOURCE STATEMENT

                  1 ;*****************************************************************************;
                  2 ;
                  3 ;                          ELECTRONIC DUCTOR CONTROL
                  4 ;
                  5 ;                                    BY
                  6 ;                               RON RODVELT
                  7 ;                         DIDDE GRAPHIC SYSTEMS CORP.
                  8 ;                            DECEMBER 23,1982
                  9 ;
                 10 ;*****************************************************************************;
                 11 ;   THIS PROGRAM IS DESIGNED TO PROVIDE THE OPERATING INSTRUCTIONS FOR THE
                 12 ;HARDWARE USED ON THE DGS COMPERFECTOR 23 TO CONTROL THE MOVEMENT OF THE
                 13 ;INK DUCTOR AND , IN TURN, THE FLOW OF INK INTO THE INK TRAIN.
                 14 ;
                 15 ;*****************************************************************************;
                 16 ;                       REGISTER AND PORT ASSIGNMENTS
                 17 ;
                 18 ;
                 19 ;       R0 - INK FLOW CONTROL INPUT
                 20 ;       R1 - ACTIVE INK FLOW CONTROL NUMBER
                 21 ;       R2 - LOOK-UP TABLE NUMBER
                 22 ;       R3 - DUCTOR CONTROL REGISTER
                 23 ;       R4 - DUCTOR CONTROL + COUNTER OVERFLOW
                 24 ;
                 25 ;       F0 - NEW INK FLOW NUMBER FLAG
                 26 ;       F1 - DUCTOR POSITION FLAG
                 27 ;
                 28 ;       T0 - FORMS MONITOR INPUT
                 29 ;       T1 - GEAR TOOTH SENSOR INPUT
                 30 ;
                 31 ;       ___
                 32 ;       INT - DUCTOR TRIGGER INPUT
                 33 ;
                 34 ;       P27-P24 - TEN'S DIGIT OF INK FLOW CONTROL NUMBER INPUT
                 35 ;       P23-P20 - ONE'S DIGIT OF INK FLOW CONTROL NUMBER INPUT
                 36 ;
                 37 ;       P17-P16 -NOT USED
                 38 ;       P15 - VIBRATOR SOLENOID CONTROL OUTPUT
                 39 ;       P14 - FOUNTAIN SOLENOID CONTROL OUTPUT
                 40 ;       P13 - AIR CYLINDER SENSOR INPUT
                 41 ;       P12-P10 - DUCTOR MODE CONTROL NUMBER INPUT
                 42 ;
                 43 ;       DB7-DB0 - BUS PORT NOT USED
                 44 ;*****************************************************************************
                 45
                 46 ;   START OF PROGRAM
                 47 ;
0000             48                ORG 00H
0000 0410        49                JMP RESET          ;AUTO START INTERRUPT
0003             50                ORG 03H
0003 0461        51                JMP TRGINT         ;TRIGGER INTERRUPT
0007             52                ORG 07H
0007 046E        53                JMP CNTINT         ;COUNTER INTERRUPT
0010             54                ORG 10H
                 55 ;-----------------------------------------------------------------------
                 56 ;
                 57 ;   RESET INTERRUPT ROUTINE
                 58 ;
                 59 ;
0010 00          60        RESET:  NOP
0011 00          61                NOP
```

```
LOC  OBJ        SEQ        SOURCE STATEMENT
0012 00          62                NOP
0013 00          63                NOP
0014 23FF        64                MOV A,#0FFH
0016 39          65                OUTL P1,A
0017 00          66                NOP
0018 23EF        67                MOV A,#0EFH        ;MOVE DUCTOR TO VIBRATOR
001A A5          68                CLR F1             ;CLEAR DUCTOR STATUS FLAG
001B 39          69                OUTL P1,A          ;AIR SUPPLY ON
                 70 ;-----------------------------------------------------------------------
                 71 ;THE SCAN ROUTINE READS THE INK FLOW CONTROL NUMBER FROM THE TWO BCD SWITCHES
                 72 ;LOCATED ON THE OFFSET SWITCH PANEL. THE PROCESSOR DETERMINES IF THE NUMBER
                 73 ;IS DIFFERENT FROM THE NUMBER IT PREVIOUSLY READ. IF DIFFERENT, THE NEW
                 74 ;NUMBER IS LOADED INTO R1, THE ACTIVE INK FLOW CONTROL NUMBER REGISTER.
                 75 ;
                 76 ;
001C 15          77        SCAN:   DIS I
001D 0A          78                IN A,P2            ;DETERMINE CONTROL MODE
001E 37          79                CPL A
001F A8          80                MOV R0,A           ;MOVE INK FLOW CONTROL NUMBER
0020 D9          81                XRL A,R1           ;TO R0.IF NEW NO. SAME AS
0021 C628        82                JZ SWSCAN          ;ACTIVE,GO TO SWSCAN.
0023 F8          83                MOV A,R0           ;IF NOT,MOVE NEW NUMBER
0024 A9          84                MOV R1,A           ;TO ACTIVE REGISTER
0025 E3          85                MOVP3 A,@A         ;GET NEW DUCTOR
0026 AB          86                MOV R3,A           ;CONTROL NUMBER
0027 AA          87                MOV R2,A
                 88 ;-----------------------------------------------------------------------
                 89 ;
                 90 ;   THE SWSCAN ROUTINE LOADS THE 3-BIT DATA FROM THE DUCTOR CONTROL SWITCH
                 91 ;AND DECIDES WHICH CONTROL MODE THE DUCTOR IS TO BE IN. IF NO VALID CONTROL
                 92 ;CODE IS FOUND, THE PROGRAM JUMPS BACK TO THE SCAN ROUTINE AND STARTS THE
                 93 ;DATA COLLECTION PROCESS OVER.
                 94 ;
                 95 ;
0028 09          96        SWSCAN: IN A,P1            ;CHECK STATUS OF
0029 5307        97                ANL A,#07H         ;CONTROL SWITCH
002B C63B        98                JZ ON              ;IF DATA=000,GOTO ON
002D 07          99                DEC A
002E C640       100                JZ AUTO            ;IF DATA=001,GOTO AUTO
0030 07         101                DEC A
0031 C65B       102                JZ FOUNT           ;IF DATA=010,GOTO FOUNT
0033 07         103                DEC A
0034 C655       104                JZ VIBRAT          ;IF DATA=011,GOTO VIBRAT
0036 07         105                DEC A
0037 C64F       106                JZ FREE            ;IF DATA=100,GOTO FREE
0039 041C       107                JMP SCAN           ;IF NO DATA MATCH IS MADE
                108                                   ;REPEAT SCAN ROUTINE
                109 ;-----------------------------------------------------------------------
                110 ;     THE ON MODE ROUTINE CHECKS THE STATUS OF THE DUCTOR CONTROL FLAG AND
                111 ;ASSURES THAT THE DUCTOR IS IN THE DESIRED POSITION. IT ALSO ENABLES THE
                112 ;TRIGGER INTERRUPT AND ALLOWS THE SYSTEM TO OPERATE INDEPENDENTLY OF THE
                113 ;FORMS CONTROL ON THE PRESS.
                114 ;
                115 ;
003B 05         116        ON:     EN I               ;ENABLE TRIGGER INTERRUPT
003C 148B       117                CALL CHKF1         ;CHECK DUCTOR POSITION
003E 041C       118                JMP SCAN
                119 ;-----------------------------------------------------------------------;
                120 ;     THE AUTO MODE ROUTINE CHECKS THE STATUS OF THE FORMS CONTROL LINE
                121 ;AND DISABLES THE DUCTOR TRIGGER AND COUNTER INTERRUPTS UNTIL THE FORMS
                122 ;ARE ACTIVATED.
                123
0040 264A       124        AUTO:   JNT0 FORMON        ;CHECK FORMS STATUS
0042 15         125                DIS I              ;IF FORMS OFF, DISABLE
0043 35         126                DIS TCNTI          ;TRIGGER & COUNTER INTERRUPTS
0044 A5         127                CLR F1             ;CLEAR DUCTOR POSITION FLAG
0045 23EF       128                MOV A,#0EFH        ;MOVE DUCTOR TO VIBRATOR
0047 39         129                OUTL P1,A
0048 041C       130                JMP SCAN
004A 05         131        FORMON: EN I               ;IF FORMS ON, ENABLE TRIGGER
```

```
LOC  OBJ        SEQ        SOURCE STATEMENT
004B 148B        132                CALL CHKF1        ;CHECK DUCTOR POSITION
004D 041C        133                JMP SCAN
                 134 ;-----------------------------------------------------------------
                 135 ;     THE FREE MODE ROUTINE TURNS OFF POWER TO BOTH OF THE AIR SOLENOIDS
                 136 ;SUPPLYING THE DUCTOR AIR CYLINDER EFFECTIVELY TAKING THE PRESSURE OFF THE
                 137 ;DUCTOR ROLLER.
                 138 ;
004F 15          139        FREE:   DIS I             ;DISABLE TRIGGER
0050 23CF        140                MOV A,#0CFH       ;TURN AIR SUPPLY OFF
0052 39          141                OUTL P1,A
0053 041C        142                JMP SCAN
                 143 ;-----------------------------------------------------------------
                 144 ;     THE VIBRAT MODE CONTROL ROUTINE DISABLES THE TRIGGER INTERRUPT AND
                 145 ;MOVES THE DUCTOR ROLLER INTO CONTACT WITH THE FIRST VEBRATOR ROLLER IN THE
                 146 ;INK TRAIN.
                 147 ;
0055 15          148        VIBRAT: DIS I             ;DISABLE TRIGGER INTERRUPT
0056 23EF        149                MOV A,#0EFH       ;MOVE DUCTOR TO VIBRATOR
0058 39          150                OUTL P1,A
0059 041C        151                JMP SCAN
                 152 ;-----------------------------------------------------------------
                 153 ;     THE FOUNT MODE CONTROL ROUTINE DISABLES THE TRIGGER INTERRUPT AND
                 154 ;MOVES THE DUCTOR ROLLER INTO CONTACT WITH THE INK FOUNTAIN ROLLER.
                 155 ;
005B 15          156        FOUNT:  DIS I             ;DISABLE TRIGGER INTERRUPT
005C 23DF        157                MOV A,#0DFH       ;MOVE DUCTOR TO FOUNTAIN
005E 39          158                OUTL P1,A
005F 041C        159                JMP SCAN
                 160 ;-----------------------------------------------------------------
                 161 ;     THE TRGINT ROUTINE IS THE SERVICE ROUTINE FOR THE TRIGGER INTERRUPT
                 162 ;WHICH OCCURS AT THE BEGINNING OF EACH DUCTOR CYCLE. HERE THE COMPUTER
                 163 ;MOVES THE DUCTOR TO THE FOUNTAIN ROLLER, ENABLES THE COUNTER INTERRUPT,
                 164 ;AND STARTS THE COUNTER.THE PROGRAM THEN JUMPS BACK TO THE SCAN ROUTINE
                 165 ;TO MONITOR THE MODE CONTROL SWITCH FOR ANY CHANGES THAT MAY OCCUR.
                 166 ;
0061 00          167        TRGINT: NOP
0062 8661        168                JNI TRGINT        ;WAIT FOR MAGNET TO PASS
0064 23DF        169                MOV A,#0DFH       ;MOVE DUCTOR TO FOUNTAIN
0066 A5          170                CLR F1            ;SET DUCTOR POSITION FLAG
0067 B5          171                CPL F1
0068 39          172                OUTL P1,A
0069 FB          173                MOV A,R3          ;LOAD DUCTOR CONTROL DATA
006A 62          174                MOV T,A           ;INTO COUNTER
006B 25          175                EN TCNTI          ;ENABLE COUNTER INTERRUPT
006C 45          176                STRT CNT          ;START COUNTER
006D 93          177                RETR              ;RETURN FROM INTERRUPT
                 178 ;-----------------------------------------------------------------
                 179 ;      CNTINT IS THE SERVICE ROUTINE FOR THE 8748 ONBOARD COUNTER
                 180 ;INTERRUPT WHICH IS GENERATED AFTER THE DESIRED NUMBER OF GEAR TEETH
                 181 ;HAVE BEEN COUNTED. A SIGNAL IS SENT TO MOVE THE DUCTOR FROM THE FOUNTAIN
                 182 ;ROLLER TO THE VIBRATOR. THE COMPUTER WAITS FOR A RETURN SIGNAL FROM THE
                 183 ;AIR CYLINDER CONFIRMING THE MOVEMENT. IF THE MOVEMENT IS NOT SIGNALLED AT
                 184 ;THE PROPER TIME, THE DUCTOR CONTROL REGISTER IS INCREMENTED OR DECREMENTED
                 185 ;TO TRY TO ACHIEVE THE PROPER TIMING ON THE NEXT CYCLE. THE RETURN TO THE
                 186 ;MAIN PROGRAM SIGNALS THE END OF THE DUCTOR CYCLE.
                 187 ;
006E 23EF        188        CNTINT: MOV A,#0EFH       ;MOVE DUCTOR TO VIBRATOR
0070 39          189                OUTL P1,A
0071 A5          190                CLR F1            ;CLEAR DUCTOR POSITION FLAG
0072 09          191        CHKCYL: IN A,P1           ;CHECK FOR AIR CYLINDER
0073 5308        192                ANL A,#08H        ;MOVEMENT
0075 C679        193                JZ ERRCAL         ;WHEN DUCTOR HAS MOVED,
0077 0472        194                JMP CHKCYL        ;CONTINUE ERROR CALCULATION
0079 65          195        ERRCAL: STOP TCNT
007A 35          196                DIS TCNTI         ;CALCULATE COUNTER OVERFLOW
007B 42          197                MOV A,T
007C 6B          198                ADD A,R3          ;CHECK IF DUCTOR CONTROL +
007D AC          199                MOV R4,A          ;COUNTER OVERFLOW=INK FLOW
```

```
LOC  OBJ        SEQ        SOURCE STATEMENT

007E DA         200                XRL A,R2          ;LOOKUP TABLE NUMBER
007F C68A       201                JZ ENDCAL
0081 FC         202                MOV A,R4          ;CHECK IF R4<R2
0082 37         203                CPL A             ;IF SO, DECREMENT DUCTOR
0083 6A         204                ADD A,R2          ;CONTROL REGISTER
0084 F689       205                JC DECREG
0086 1B         206                INC R3            ;IF NOT,INCREMENT DUCTOR
0087 048A       207                JMP ENDCAL        ;CONTROL REGISTER
0089 CB         208        DECREG: DEC R3
008A 93         209        ENDCAL: RETR              ;RETURN FROM INTERRUPT
                210 ;-----------------------------------------------------------------
                211 ;     F1 IS A FLAG USED BY THE COMPUTER TO KEEP TRACK OF WHERE THE DUCTOR
                212 ;SHOULD BE AT ANY POINT IN THE PROGRAM. CHKF1 IS THE ROUTINE THAT IS USED
                213 ;PERIODICALLY BY THE CONTROL SYSTEM TO MAKE SURE THE DUCTOR IS IN THE PROPER
                214 ;POSITION.
                215 ;
008B 7691       216        CHKF1:  JF1 DUCTON        ;IF F1=1 GOTO DUCTON
008D 23EF       217                MOV A,#0EFH       ;IF F1=0 MOVE
008F 39         218                OUTL F1,A         ;DUCTOR TO VIBRATOR
0090 83         219                RET
0091 23DF       220        DUCTON: MOV A,#0DFH       ;MOVE DUCTOR
0093 39         221                OUTL F1,A         ;TO FOUNTAIN
0094 83         222                RET
                223 ;-----------------------------------------------------------------
                224 ;    THE LOOK-UP TABLE CONTAINS THE TWO'S COMPLEMENT VALUE OF THE NUMBER OF
                225 ;GEAR TEETH EXPECTED TO BE COUNTED FOR A GIVEN VALUE OF THE INK FLOW CONTROL
                226 ;NUMBER.THE TABLE IS ARRANGED TO FACILITATE AN INDEXED PAGE 3 RETRIEVAL OF THE
                227 ;VALUE TO BE LOADED INTO THE 8748 ONBOARD COUNTER.
                228 ;
                229 ;
0300            230                ORG 300H          ;THIS IS THE LOOK UP
                231                                  ;TABLE
0300 F1         232                DB 0F1H,0EBH,0E9H,0E7H,0E5H,0E4H,0E3H,0E2H
0301 EB
0302 E9
0303 E7
0304 E5
0305 E4
0306 E3
0307 E2
0308 E1         233                DB 0E1H,0E0H
0309 E0
0310            234                ORG 310H
0310 DF         235                DB 0DFH,0DEH,0DDH,0DCH,0DBH,0DAH,0D9H,0D9H
0311 DE
0312 DD
0313 DC
0314 DB
0315 DA
0316 D9
0317 D9
0318 D8         236                DB 0D8H,0D7H
0319 D7
0320            237                ORG 320H
0320 D6         238                DB 0D6H,0D6H,0D5H,0D4H,0D4H,0D3H,0D2H,0D2H
0321 D6
0322 D5
0323 D4
0324 D4
0325 D3
0326 D2
0327 D2
0328 D1         239                DB 0D1H,0D0H
0329 D0
0330            240                ORG 330H
0330 D0         241                DB 0D0H,0CFH,0CFH,0CEH,0CDH,0CDH,0CCH,0CCH
0331 CF
0332 CF
```

```
LOC  OBJ        SEQ        SOURCE STATEMENT

0333 CE
0334 CD
0335 CD
0336 CC
0337 CC
0338 CB         242                DB 0CBH,0CAH
0339 CA
0340            243                ORG 340H
0340 CA         244                DB 0CAH,0C9H,0C9H,0C8H,0C7H,0C7H,0C6H,0C6H
0341 C9
0342 C9
0343 C8
0344 C7
0345 C7
0346 C6
0347 C6
0348 C5         245                DB 0C5H,0C5H
0349 C5
0350            246                ORG 350H
0350 C4         247                DB 0C4H,0C4H,0C3H,0C2H,0C2H,0C1H,0C1H,0C0H
0351 C4
0352 C3
0353 C2
0354 C2
0355 C1
0356 C1
0357 C0
0358 BF         248                DB 0BFH,0BFH
0359 BF
0360            249                ORG 360H
0360 BE         250                DB 0BEH,0BEH,0BDH,0BCH,0BCH,0BBH,0BBH,0BAH
0361 BE
0362 BD
0363 BC
0364 BC
0365 BB
0366 BB
0367 BA
0368 B9         251                DB 0B9H,0B9H
0369 B9
0370            252                ORG 370H
0370 B8         253                DB 0B8H,0B8H,0B7H,0B6H,0B6H,0B5H,0B4H,0B4H
0371 B8
0372 B7
0373 B6
0374 B6
0375 B5
0376 B4
0377 B4
0378 B3         254                DB 0B3H,0B2H
0379 B2
0380            255                ORG 380H
0380 B2         256                DB 0B2H,0B1H,0B0H,0AFH,0AFH,0AEH,0ADH,0ACH
0381 B1
0382 B0
0383 AF
0384 AF
0385 AE
0386 AD
0387 AC
0388 AB         257                DB 0ABH,0AAH
0389 AA
0390            258                ORG 390H
0390 A9         259                DB 0A9H,0A8H,0A7H,0A6H,0A5H,0A4H,0A3H,0A1H
0391 A8
0392 A7
0393 A6
0394 A5
```

```
LOC  OBJ        SEQ        SOURCE STATEMENT

0395 A4
0396 A3
0397 A1
0398 9F         260                DB 9FH,9BH
0399 9B
                261                END

USER SYMBOLS
AUTO   0040   CHKCYL 0072   CHKF1  008B   CNTINT 006E   DECREG 0089   DUCTON 0091   ENDCAL 008A   ERRC
FORMON 004A   FOUNT  005B   FREE   004F   ON     003B   RESET  0010   SCAN   001C   SWSCAN 0028   TRGI
VIBRAT 0055

ASSEMBLY COMPLETE,  NO ERRORS
```

I claim:

1. A method of controlling the amount of ink transferred to an ink train in a printing press, wherein the printing press includes a fountain roller in operable contact with an ink supply and a ductor roller shiftable between an ink train contact position and a fountain roller contact portion, said method comprising the steps of:

providing a control processor;

inputting an operating instruction into said processor indicative of the desired amount of ink transfer;

shifting the ductor roller into contact with the fountain roller;

rotating the fountain roller thereby transferring ink to the ductor roller during the interval contact is established therebetween and the fountain roller is rotated;

determining the amount of rotational movement of the fountain roller during said interval and transmitting the same as a rotation signal to the control processor, said processor being operable when a programmed relationship exists between said rotation signal and said operating instruction to initiate a disconnect of the ductor roller from contact with the fountain roller;

initiating disconnect of the ductor roller from contact with the fountain roller when said processor determines that said programmed relationship exists, thereby controlling the amount of ink transferred from the fountain roller to the ductor roller; and shifting said ductor roller into contact with said ink train for transferring ink from said ductor roller to said ink train.

2. A method as set forth in claim 1, and including the steps of:

providing a transmission which causes intermittent rotational movement of said fountain roller in a repetitive duty cycle;

sensing when said transmission is beginning a duty cycle and transmitting the same as a start signal to the processor; and initiating shifting of the ductor roller into contact with the fountain roller after receipt of said start signal by said processor.

3. A method as set forth in claim 2, said shifting of said ductor roller into contact with said fountain roller occuring to bring the ductor roller into contact with the fountain roller before the fountain roller begins rotation.

4. A method as set forth in claim 1, and including the steps of:

providing a transmission which causes intermittent rotational movement of said fountain roller, said transmission having a rotatable gear operatively linked to the fountain roller, said gear having a plurality of spaced-apart markings thereon;

determining the amount of rotational movement of the fountain roller during said interval by counting the number of markings passing a marking sensor as the gear rotates; and transmitting said counting of the markings as said rotation signal comprising a series of electronic pulses from the marking sensor to the processor, each pulse corresponding to a marking whereby the processor operates to count pulses until said programmed relationship exists.

5. A method as set forth in claim 1, including the steps of:

determining when the ductor roller disconnects from contact with the fountain roller and transmitting the same as a disconnect signal to the processor;

comparing the difference between said disconnect signal and initiation of the disconnect by the processor; and adjusting said programmed relationship in accordance with said difference.

6. A method as set forth in claim 5, including the steps of:

(1) providing a transmission which causes rotational movement of said fountain roller, said transmission including a rotatable gear having a plurality of spaced apart markings thereon and a marking sensor for indicating passage of the markings therepast;

(2) determining the number of markings indicated by said marking sensor between said disconnect signal and initiation of the disconnect by the processor;

(3) transmitting said number of markings to said processor; and (4) changing said programmed relationship in accordance with said number of markings.

7. In a printing press, an ink flow control comprising:

an ink supply;

a fountain roller operably connected to said ink supply;

a ductor roller;

means for shifting said ductor roller into and out of contact with said fountain roller for transferring ink from the fountain roller to the ductor roller during the interval contact is established therebetween and the rollers are rotating;

sensor means for providing a signal representative of the amount of ink transferred as a result of rotational movement of said fountain roller while the ductor roller is in contact therewith;

means for providing an operating instruction input indicative of the desired amount of ink to be transferred from the fountain roller to the ductor roller; and processor means for receiving said input and for receiving said signal from said sensor means, said processor means being operable for comparing the signal from said sensor means with the operating instruction input and to control shifting of the ductor roller to establish and regulate the interval said ductor roller is in ink transferring relationship to said fountain roller in accordance with said input.

8. An ink flow control as set forth in claim 7, wherein said processor means controls said interval by initiating operation of said shifting means for disengaging said ductor roller from a position in ink transferring contact with said fountain roller when a programmed relationship exists between said operating instruction input and said signal.

9. An ink flow control as set forth in claim 8; and feedback means for determining when said ductor roller disengages from contact with said fountain roller and for supplying as indication thereof to said processor means, said processor means being operable to compare the delay between said indication and initiation of said ductor roller shifting and to adjust said programmed relationship to account for said delay.

10. An ink flow control as set forth in claim 7; and transmission means for providing intermittent rotational movement of the fountain roller in a duty cycle of rotation and non rotation, said transmission including a rotatable gear operatively interconnected to said fountain roller.

11. An ink flow control as set forth in claim 10; and indicia coupled to said gear for indicating the start of a duty cycle and means for detecting said indicia and for transmitting the same as a start signal to said processor means.

12. An ink flow control as set forth in claim 11, said indicia comprising a magnet and said detection means including a Hall effect sensor disposed for determining passage of said magnet therepast.

13. An ink flow control as set forth in claim 10; and including spaced-apart markings on said gear and said sensor means includes mechanism for detecting passage of said markings therepast whereby the number of markings detected correlates to the amount of rotational movement of said fountain roller.

14. An ink flow control as set forth in claim 13, said markings being a plurality of equidistant, circumferentially spaced-apart teeth on said gear and said detecting mechanism being an inductive-type sensor for counting the teeth as the gear moves.

15. An ink flow control as set forth in claim 9, said shifting means including a fluid-actuated piston operatively connected to said ductor roller and said feedback means including a magnet attached to said piston and an indicator for determining movement of said magnet therepast, said indicator disposed relative said piston for triggering an indication when said ductor roller disengages from contact with said fountain roller.

16. An ink flow control as set forth in claim 11, wherein said processor is operable to initiate operation of said shifting means for bringing said ductor roller into contact with said fountain roller upon receipt of said start signal.

17. An ink flow control as set forth in claim 16, said indicia disposed on said gear for bringing said ductor roller into contact with said fountain roller before rotation of said fountain roller.

* * * * *